United States Patent [19]

Shafe et al.

[11] Patent Number: 4,980,541

[45] Date of Patent: Dec. 25, 1990

[54] CONDUCTIVE POLYMER COMPOSITION

[75] Inventors: Jeff Shafe; O. James Straley, both of Redwood City; Gordon McCarty, San Jose; Ravinder K. Oswal, Union City; Bernadette A. Trammell, Menlo Park, all of Calif.

[73] Assignee: Raychem Corporation, Menlo Park, Calif.

[21] Appl. No.: 416,748

[22] Filed: Oct. 3, 1989

Related U.S. Application Data

[63] Continuation of Ser. No. 247,059, Sep. 20, 1988, abandoned.

[51] Int. Cl.[5] ..... H05B 3/12

[52] U.S. Cl. ..... 219/548; 219/505; 219/553; 338/22 R

[58] Field of Search ..... 219/548, 549, 541, 553, 219/504, 505; 338/223, 327, 22 R, 306; 106/472

[56] References Cited

U.S. PATENT DOCUMENTS

| | | | |
|---|---|---|---|
| 4,237,441 | 12/1980 | Van Konynenburg et al. | 338/22 |
| 4,277,673 | 7/1971 | Kelly | 219/528 |
| 4,304,987 | 12/1981 | Van Konyenenburg | 219/553 |
| 4,374,113 | 2/1983 | Yates et al. | 423/445 |
| 4,388,607 | 6/1983 | Toy et al. | 338/22 |
| 4,591,700 | 5/1986 | Sopory | 219/505 |
| 4,668,857 | 5/1987 | Smuckler | 219/549 |
| 4,818,439 | 4/1989 | Blackledge et al. | 252/511 |

FOREIGN PATENT DOCUMENTS

| | | |
|---|---|---|
| 123540 | 10/1984 | European Pat. Off. . |
| 235454 | 9/1987 | European Pat. Off. . |

*Primary Examiner*—Roy N. Envall, Jr.

*Attorney, Agent, or Firm*—Marguerite E. Richardson Gerstner

[57] ABSTRACT

Electrical devices with improved resistance stability comprise a PTC element comprising a conductive polymer and two electrodes. The conductive polymer composition comprises an organic crystalline polymer and carbon black with a pH of less than 5.0. Particularly preferred conductive polymer compositions comprise carbon blacks which have a pH of less than 5.0, a dry resistivity $R_{CB}$ and a particle size D in nanometers such that $R_{CB}/D$ is at most 0.1. Electrical devices of the invention include heaters and circuit protection devices.

19 Claims, No Drawings

CONDUCTIVE POLYMER COMPOSITION

CROSS-REFERENCE TO RELATED APPLICATIONS

This application is a continuation of copending, commonly assigned application Ser. No. 07/247,059 (Shafe et al.), filed Sept. 20, 1988, the disclosure of which is incorporated by reference herein.

BACKGROUND OF THE INVENTION

1. Field of the Invention

This invention relates to conductive polymer compositions and electrical devices comprising them.

2. Background of the Invention

Conductive polymer compositions and electrical devices such as heaters and circuit protection devices comprising them are well-known. Reference may be made, for example, to U.S. Pat. Nos. 3,793,716, 3,823,217, 3,858,144, 3,861,029, 3,914,363, 4,017,715, 4,177,376, 4,188,276, 4,237,441, 4,304,987, 4,318,881, 4,334,148, 4,388,607, 4,426,339, 4,459,473, 4,514,620, 4,534,889, 4,545,926, 4,560,498, 4,658,121, 4,719,334, and 4,761,541, European Patent Publication No. 38,718 (Fouts et al), and copending, commonly assigned application Ser. Nos. 818,846 (Barma) filed Jan. 14, 1986 now abandoned, 53,610 filed May 20, 1987 (Batliwalla, et al.) now U.S. Pat. No. 4,777,351, 75,929 (Barma et al.) filed July 21, 1987, 189,938 (Friel) filed May 3, 1988, 202,165 (Oswal, et al.) filed June 3, 1988, 202,762 (Sherman, et al.) filed June 3, 1988, 219,416 (Horsma et al.) filed July 15, 1988, and 247,026 (Shafe et al.) filed contemporaneously with this application, the disclosures of which are incorporated herein by reference.

Conductive polymer compositions which exhibit PTC (positive temperature coefficient of resistance) behavior are particularly useful for self-regulating strip heaters and circuit protection devices. These electrical devices utilize the PTC anomaly, i.e. an anomalous rapid increase in resistance as a function of temperature, to limit the heat output of a heater or the current flowing through a circuit. Compositions which exhibit PTC anomalies and comprise carbon black as the conductive filler have been disclosed in a number of references. U.S. Pat. No. 4,237,441 (van Konynenburg et al.) discloses suitable carbon blacks for use in PTC compositions with resistivities less than 7 ohm-cm. U.S. Pat. No. 4,388,607 (Toy et al) discloses appropriate carbon blacks for use in compositions for strip heaters. U.S. application Ser. No. 202,762 (Sherman et al.) discloses the use of semiconductive fillers of relatively high resistivity in combination which carbon black to produce stable conductive polymer compositions with high resistivity. U.S. Pat. No. 4,277,673 (Kelly) discloses self-regulating articles which comprise highly resistive carbon blacks. These blacks, either alone or in combination with a low resistivity carbon black, form PTC compositions which provide significantly shorter annealing times.

As indicated in the references, a large number of carbon blacks are suitable for use in conductive compositions. The choice of a particular carbon black is dictated by the physical and electrical properties of the carbon black and the desired properties, e.g. flexibility or conductivity, of the resulting composition. The properties of the carbon blacks are affected by such factors as the particle size, the surface area, and the structure, as well as the surface chemistry. This chemistry can be altered by heat or chemical treatment, either during the production of the carbon black or in post-production process, e.g. by oxidation. Oxidized carbon blacks frequently have a low surface pH value, i.e. less than 5.0, and may have a relatively high volatile content. When compared to nonoxidized carbon blacks of similar particle size and structure, oxidized carbon blacks have higher resistivities. It is known that carbon blacks which are oxidized provide improved flow characteristics in printing inks, improved wettability in certain polymers, and improved reinforcement of rubbers.

SUMMARY OF THE INVENTION

We have now found that conductive polymer compositions with improved thermal stability can be made when the conductive filler comprises carbon black with a low pH. We have found that the use of such carbon blacks results in an increased PTC anomaly when compared to similar, nonoxidized carbon blacks, even when the composition is more highly reinforced due to an increased filler content required to compensate for higher resistivity. Therefore, in one aspect, this invention provides an electrical device which comprises (1) a PTC element comprising a conductive polymer composition which exhibits PTC behavior, which has a resistivity at 20° C. $R_{cp}$, and which comprises
   (a) an organic polymer which has a crystallinity of at least 5% and a melting point $T_m$, and
   (b) carbon black which has a pH of less than 5.0; and
(2) two electrodes which can be connected to a source of electrical power to pass current through the PTC element, said electrical device having a resistance $R_i$ at 20° C. and being such that if the device is maintained at a temperature equal to $T_m$ for a period of 50 hours and is then cooled to 20° C., its resistance at 20° C., $R_{f50}$, is from $0.25R_i$ to $1.75R_i$.

We have found that the physical and electrical properties of the carbon black may be used to determine suitable fillers for use in compositions of the invention. Therefore, in a second aspect the invention provides a conductive polymer composition which exhibits PTC behavior and which comprises (1) an organic polymer which has a crystallinity of at least 5% and a melting point $T_m$, and
(2) carbon black which has a pH of less than 5.0, a particle size of D nanometers and a dry resistivity $R_{CB}$ such that $(R_{CB}/D)$ is less than or equal to 0.1.

DETAILED DESCRIPTION OF THE INVENTION

The carbon blacks useful in the conductive polymer compositions of this invention gave pH values of less than 5.0, preferably less than 4.0, particularly less than 3.0. The pH is a measure of the acidity or alkalinity of the carbon black surface. A pH of 7.0 indicates a chemically neutral surface; values less than 7.0 are acidic, those higher than 7.0 are basic. Low pH carbon blacks generally have a relatively high volatile content, volatile content being a measure of the amount of chemisorbed oxygen which is present on the surface of the carbon black. The amount of oxygen can be increased by oxidation in a post-production process. The resulting carbon black will have a higher surface activity. For purposes of this specification, the terms "low pH carbon black" and "oxidized carbon black" are used as equivalent terms. The pH of the carbon black is that which is measured prior to mixing the carbon black with the polymer.

The low pH carbon blacks of this invention are used in conductive polymer compositions which exhibit PTC (positive temperature coefficient) behavior in the temperature range of interest when connected to a source of electrical power. The terms "PTC behavior" and "composition exhibiting PTC behavior" are used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. In contrast, "ZTC behavior" is used to denote a composition which increases in resistivity by less than 6 times, preferably less than 2 times in any 30° C. temperature range within the operating range of the heater.

Carbon blacks with suitable size, surface area and structure for use in PTC compositions are well-known. Guidelines for selecting such carbon blacks are found in U.S. Pat. Nos. 4,237,441 (van Konynenburg et al.) and 4,388,607 (Toy et al.), the disclosures of which are incorporated herein by reference. In general, carbon blacks with a relatively large particle size, D (measured in nanometers), e.g. greater than 18 nm, and relatively high structure, e.g. greater than about 70 cc/100 g, are preferred for PTC compositions.

Carbon blacks which are particularly preferred for compositions of the invention are those which meet the criteria that the ratio of the resistivity of the carbon black (in powder form) to the particle size (in nanometers) is less than or equal to 0.1, preferably less than or equal to 0.09, particularly less than or equal to 0.08. The resistivity of the carbon black in ohm-cm is determined by following the procedure described in Columbian Chemicals Company bulletin "The Dry Resistivity of Carbon Blacks" (AD1078), the disclosure of which is incorporated herein by reference. In this test, 3 grams of carbon black are placed inside a glass tube between two brass plungers. A 5 kg weight is used to compact the carbon black. Both the height of the compacted carbon black and the resistance in ohms between the brass plunger electrodes are noted and the resistivity is calculated. The ratio is useful for carbons which are tested in their powder, not pelletized, form. While most nonoxidized carbon blacks fulfill the requirements of this ratio, the carbon blacks particularly useful in this invention are those which both meet the ratio and have a pH of less than 5.0.

Other conductive fillers may be used in combination with the designated carbon black. These fillers may comprise nonoxidized carbon black, graphite, metal, metal oxide, or any combination of these. When a nonoxidized carbon black, i.e. a carbon black with a pH of at least 5.0, is present, it is preferred that the pH of the nonoxidized carbon black be at least 1.0 pH unit greater than the pH of the oxidized carbon black. It is preferred that the low pH carbon black be present at a level of at least 5% by weight, preferably at least 10% by weight, particularly at least 20% by weight of the total conductive filler, e.g. 25 to 100% by weight of the total conductive filler. For most compositions of the invention, the low pH carbon black comprises at least 4% by weight, preferably at least 6% by weight, particularly at least 8% by weight of the total composition. For compositions which comprise inks, the presence of the solvent is neglected and the content of the solid components, e.g. carbon black and polymer, is considered the total composition.

Commercially available carbon blacks which have low pH values may be used. Alternatively, nonoxidized carbon blacks may be treated, e.g. by heat or appropriate oxidizing agents, to produce carbon blacks with appropriate surface chemistry.

The conductive polymer composition comprises an organic polymer which has a crystallinity of at least 5%, preferably at least 10%, particularly at least 15%, e.g. 20 to 30%. Suitable crystalline polymers include polymers of one or more olefins, particularly polyethylene; polyalkenamers such as polyoctenamer; copolymers of at least one olefin and at least one monomer copolymerisable therewith such as ethylene/acrylic acid, ethylene/ethyl acrylate, and ethylene/vinyl acetate copolymers; melt-shapeable fluoropolymers such as polyvinylidene fluoride, ethylene/tetrafluoroethylene copolymers, and terpolymers of vinylidene fluoride, hexafluoropropylene, and tetrafluoroethylene; and blends of two or more such polymers. (The term "fluoropolymer" is used herein to denote a polymer which contains at least 10%, preferably at least 25%, by weight of fluorine, or a mixture of two or more such polymers.) In order to achieve specific physical or thermal properties for some applications, it may be desirable to blend one crystalline polymer with another polymer, either crystalline or amorphous. When there are two or more polymers in the composition, the blend must have a crystallinity of at least 5%. The crystallinity, as well as the melting point $T_m$ are determined from a DSC (differential scanning calorimeter) trace on the conductive polymer composition. The $T_m$ is defined as the temperature at the peak of the melting curve. If the composition comprises a blend of two or more polymers, $T_m$ is defined as the lowest melting point measured for the composition (often corresponding to the melting point of the lowest melting component).

The composition may comprise additional components, e.g. inert fillers, antioxidants, flame retardants, prorads, stabilizers, dispersing agents. Mixing may be conducted by any suitable method, e.g. melt-processing, sintering, or solvent-blending. Solvent-blending is particularly preferred when the conductive polymer composition comprises a polymer thick film ink, such as those disclosed in U.S. application Ser. No. 247,026 (Shafe et al.), filed contemporaneously with this application. The composition may be crosslinked by irradiation or chemical means.

The conductive polymer composition of the invention is used as part of a PTC element in an electrical device, e.g. a heater, a sensor, or a circuit protection device. The resistivity of the composition is dependent on the function of the electrical device, the dimensions of the PTC element, and the power source to be used. The resistivity may be, for example, from 0.01 to 100 ohm-cm for circuit protection devices which are powered at voltages from 15 to 600 volts, 10 to 1000 ohm-cm for heaters powered at 6 to 60 volts, or 1000 to 10,000 ohm-cm or higher for heaters powered at voltages of at least 110 volts. The PTC element may be of any shape to meet the requirements of the application. Circuit protection devices and laminar heaters frequently comprise laminar PTC elements, while strip heaters may be rectangular, elliptical, or dumbell- ("dogbone-") shaped. When the conductive polymer composition comprises an ink, the PTC element may be screen-printed or applied in any suitable configuration. Appropriate electrodes, suitable for connection to a source of electrical power, are selected depending on the shape of the PTC element. Electrodes may comprise metal wires or braid, e.g. for attachment to or embedment into the PTC element, or they may comprise metal sheet, metal mesh, conductive (e.g. metal- or carbon-filled) paint, or any other suitable material.

The electrical devices of the invention show improved stability under thermal aging and electrical stress. When a device is maintained at a temperature equal to $T_m$ for a period of 50 hours, the resistance at 20° C. measured after aging, i.e. $R_{f50}$, will differ from the initial resistance at 20° C., i.e. $R_i$, by no more than 75%, preferably no more than 60%, particularly no more than 50%, producing an $R_{f50}$ of from $0.25R_i$ to $1.75R_i$, preferably from $0.40R_i$ to $1.60R_i$, particularly from $0.50R_i$ to $1.50R_i$. If a similar test is conducted for 300 hours, the change in resistance will be less than 50%, preferably less than 40%, particularly less than 30%, producing a resistance at 20° C. after 300 hours, $R_{f300}$, of from $0.50R_i$ to $1.50R_i$, preferably from $0.60R_i$ to $1.40R_i$, particularly from $0.70R_i$ to $1.30R_i$. It is to be understood that if a device meets the resistance requirement when tested at a temperature greater than $T_m$, it will also meet the requirement when tested at $T_m$. Similar results will be observed when the device is actively powered by the application of voltage. The change in resistance may reflect an increase or decrease in device resistance. In some cases, the resistance will first decrease and then increase during the test, possibly reflecting a relaxation of mechanically-induced stresses followed by oxidation of the polymer. Particularly preferred compositions comprising fluoropolymers may exhibit stability which is better than a 30% change in resistance.

The invention is illustrated by the following examples.

EXAMPLES 1 TO 10

For each example, an ink was prepared by blending the designated percent by weight (of solids) of the appropriate carbon black with dimethyl formamide in a high shear mixer. The solution was then filtered and powdered Kynar 9301 (a terpolymer of vinylidene fluoride, hexafluoropropylene, and tetrafluoroethylene with a melting point of about 88° C., available from Pennwalt) in an amount to (100−% carbon black) was added to the filtrate and allowed to dissolve over a period of 24 to 72 hours. (Approximately 60% solvent and 40% solids was used in making the ink). Silver-based ink electrodes (Electrodag 461SS, available from Acheson Colloids) were printed onto ethylene-tetrafluoroethylene substrates and samples of each were applied. Samples of each ink were aged in ovens at temperatures of 65°, 85°, 107° and 149° C. Periodically, the samples were removed from the oven and the resistance at room temperature (nominally 20° C.), $R_t$, was measured. Normalized resistance, $R_n$, was determined by dividing $R_t$ by the initial room temperature resistance, $R_i$. The extent of instability was determined by the difference between $R_n$ and 1.00. Those inks which comprised carbon blacks with a pH of less than 5 were generally more stable than the inks comprising higher pH blacks.

TABLE I

Stability of Conductive Inks After Aging at Elevated Temperature for 300 Hours (Resistance Measured at Room Temperature)

| Carbon Example/Black | pH | Wt % CB | $R_n$ @ 65° C. | $R_n$ @ 85° C. | $R_n$ @ 107° C. | $R_n$ @ 149° C. |
|---|---|---|---|---|---|---|
| 1 Conductex SC | 7.0 | 3.0 | 1.22 | 1.75 | 5.61 | 6.39 |
| 2 Raven 1500 | 6.0 | 3.0 | 1.01 | 1.92 | 11.88 | 20.0 |
| 3 Raven 890 | 6.5 | 6.0 | 1.27 | 1.77 | 2.92 | 6.07 |
| 4 Raven 850 | 7.0 | 4.0 | 1.32 | 2.05 | 4.08 | 8.48 |
| 5 Raven 1000 | 6.0 | 4.0 | 1.18 | 1.43 | 1.94 | 4.40 |
| 6 Raven 16 | 7.0 | 5.6 | 1.11 | 1.89 | — | — |
| 7 Raven 5750 | 2.1 | 8.1 | 0.87 | 0.92 | 0.97 | 0.56 |
| 8 Raven 1040 | 2.8 | 9.1 | 0.96 | 1.15 | 1.47 | 1.34 |
| 9 Raven 1255 | 2.5 | 6.0 | 1.04 | 1.26 | 1.12 | 0.65 |
| 10 Raven 14 | 3.0 | 7.0 | 0.82 | 1.00 | — | — |

Notes to Table I:
(1) Conductex and Raven are trademarks for carbon blacks available from Columbian Chemicals.
(2) Wt % CB indicates the percent by weight of carbon black used in each ink.
(3) Carbon blacks in Examples 1, 2 and 3 produced inks with ZTC characteristics.

Measurements on two samples at 93° C. (i.e. $T_m+5°$ C.) showed that after 50 hours Example 6 (pH=7.0) had an $R_n$ of 2.53 and Example 10 (pH 3.0) had an $R_n$ of 1.48.

The $R_n$ values for Examples 1 to 6 and Examples 7 to 10 were averaged for each time interval at the test temperatures. The results, shown in Table II, indicate that the carbon blacks with high pH values were significantly less stable than those with low pH values.

TABLE II

| | Average $R_n$ Values | | | | | | | | | | | |
|---|---|---|---|---|---|---|---|---|---|---|---|---|
| | Hours @ 65° C. | | | Hours @ 85° C. | | | Hours @ 107° C. | | | Hours @ 149° C. | | |
| Example | 300 | 675 | 1256 | 300 | 675 | 1256 | 300 | 675 | 1256 | 300 | 675 | 1256 |
| 1 to 6 (pH>5) | 1.2 | 1.2 | 1.2 | 1.8 | 1.8 | 1.9 | 5.3 | 7.9 | 9.0 | 9.1 | 14.2 | 15.6 |
| 7 to 10 (pH<5) | 0.9 | 0.9 | 0.9 | 1.1 | 1.0 | 1.0 | 1.2 | 1.3 | 1.3 | 0.9 | 1.0 | 1.0 |

Additional tests were conducted on samples from Examples 6 and 10 in order to determine the stability of the compositions under applied voltage. After measuring the initial room temperature resistance, the samples were placed in environmental chambers maintained at either 20° or 65° C. and appropriate voltage was applied to each sample in order to produce comparable watt densities. Periodically, the voltage was disconnected and the resistance of each sample measured. $R_n$ was calculated as previously described. It is apparent from the results in Table III that the samples containing the oxidized carbon black were more stable than those with nonoxidized carbon black.

TABLE III

| | pH | Applied Volts | Power (w/in²) Samples at 20° C. | Power (w/in²) Samples at 65° C. | $R_n$ of Samples After Active Testing (Time in Hours) $R_n$ 20° C. 300 | $R_n$ 20° C. 600 | $R_n$ 20° C. 1000 | $R_n$ 20° C. 4000 | $R_n$ 65° C. 300 | $R_n$ 65° C. 600 | $R_n$ 65° C. 1000 | $R_n$ 65° C. 4000 |
|---|---|---|---|---|---|---|---|---|---|---|---|---|
| Example 6 Raven 16 | 7.0 | 120 | 2.3 | 2.8 | 1.1 | 1.3 | 1.5 | 6.0 | 1.4 | 1.5 | 1.5 | 2.0 |
| Example 10 Raven 14 | 3.0 | 240 | 1.9 | 3.1 | 0.8 | 0.8 | 0.8 | 0.7 | 0.9 | 0.8 | 0.7 | 0.8 |

EXAMPLES 11 TO 14

Following the procedure of Examples 1 to 10, inks were prepared using Kynar 9301 as a binder and incorporating the carbon blacks listed in Table IV. The resistance vs. temperature characteristics were measured by exposing samples of each ink to a temperature cycle from 20° C. to 82° C. The height of the PTC anomaly was determined by dividing the resistance at 82° C. ($R_{82}$) by the resistance at 20° C. ($R_{20}$). It was apparent that at comparable resistivity values the PTC anomaly was higher for the oxidized carbon blacks than for the nonoxidized carbon blacks.

TABLE V

| | $R_n$ Values for Extruded Fibers Time in Hours 146 | 265 | 743 | 1058 | 1687 | 2566 |
|---|---|---|---|---|---|---|
| 85° C.: | | | | | | |
| Ex. 15 (Raven 16) | 2.61 | 3.13 | 3.12 | — | — | — |
| Ex. 16 (Raven 14) | 1.40 | 1.23 | 1.05 | 1.15 | 1.15 | 1.16 |
| 107° C.: | | | | | | |
| Ex. 15 (Raven 16) | 3.95 | 4.40 | 101 | — | — | — |
| Ex. 16 (Raven 14) | 0.78 | 0.98 | 1.12 | 0.80 | 1.16 | 1.05 |
| 149° C.: | | | | | | |
| Ex. 15 (Raven 16) | 27.6 | 137 | 604 | — | — | — |
| Ex. 16 (Raven 14) | 0.65 | 1.07 | 1.52 | 1.43 | 1.91 | 2.83 |

TABLE IV

| Example | Carbon Black | pH | D (nm) | S.A. ($m^2/g$) | DBP (cc/100 g) | $R_{CB}$ (ohm-cm) | $R_{CB}/D$ | Wt % | Rho (ohm-cm) | PTC Height |
|---|---|---|---|---|---|---|---|---|---|---|
| 11 | Raven 1000 | 6.0 | 28 | 95 | 63 | 2.46 | 0.088 | 4.0 | 750 | 3.1x |
| 12 | Raven 1040 | 2.8 | 28 | 90 | 99 | 19.20 | 0.695 | 9.1 | 720 | 13.0x |
| 13 | Raven 450 | 8.0 | 62 | 33 | 67 | 1.36 | 0.021 | 5.0 | 150 | 23x |
| 14 | Raven 14 | 3.0 | 59 | 45 | 111 | 4.36 | 0.074 | 12.0 | 100 | 42x |

Notes to Table IV:
(1) D represents the particle size of the carbon black in nm.
(2) S.A. represents the surface area of the carbon black in $m^2/g$ as measured by a BET nitrogen test.
(3) DBP is a measure of the structure of the carbon black and is determined by measuring the amount in cubic centimeters of dibutyl phthalate absorbed by 100 g of carbon black.
(4) Wt % represents the percent by weight of the total solids content of the ink that is carbon black.
(5) Rho is the resistivity of the ink in ohm-cm.
(6) PTC Height is the height of the PTC anomaly as determined by R82/R20.
(7) $R_{CB}$ is the dry resistivity of the carbon black in powder form under a 5 kg load.
(8) $R_{CB}/D$ is the ratio of the dry resistivity of the carbon black to the particle size.

EXAMPLE 15

Using a Brabender mixer, 85% by weight of Kynar 9301 was melt-processed with 15% by weight of Raven 16. (Raven 16 has a pH of 7.0, a particle size of 61 nm, a surface area of 25 $m^2/g$, a DBP of 105 cc/100 g and a dry resistivity of 1.92.) The compound was pelletized and then extruded through a strand die to produce a fiber with a diameter of approximately 0.070 inch (0.18 cm). Silver paint (Electrodag 504 available from Acheson Colloids) was used to apply electrodes to pieces of the fiber. The fiber pieces were then tested at 85° C., 107° C., and 149° C. following the procedure of Examples 1 to 10. The results are shown in Table V. The test for these samples was discontinued after 743 hours.

EXAMPLE 16

Following the procedure of Example 15, 20% by weight of Raven 14 was mixed with Kynar 9301, extruded into a fiber, and thermally aged. The results as shown in Table V indicate that this oxidized carbon black was more stable on aging than a similar carbon black with a higher pH. When tested at 93° C., i.e. ($T_m$+5)°C., fibers of Example 15 had an $R_n$ after 50 hours of 2.76; those of Example 16 had an $R_n$ of 1.73.

EXAMPLE 17

Following the procedure of Example 15, fibers were prepared by blending 55% by weight Elvax 250 (ethylene vinyl acetate copolymer with a melting point of 60° C., available from Dow) and 45% by weight Raven 22 (carbon black with a pH of 7.0, a particle size of 62 nm, a surface area of 25 $m^2/g$, and a DBP of 113 cc/100 g, available from Columbian Chemicals). An ink was prepared by dissolving the fibers in xylene. After 813 hours at 52° C., the $R_n$ value was 0.94.

EXAMPLE 18

Following the procedure of Example 17, fibers were first prepared with 50% by weight Raven 14 in Elvax 250 and were then dissolved in xylene. After 813 hours at 52° C., the $R_n$ value of the ink was 0.88.

EXAMPLE 19

Fibers were prepared from 76% by weight PFA 340 (a copolymer of tetrafluoroethylene and a perfluorovinyl ether with a $T_m$ of 307° C., available from du Pont) and 24% by weight Raven 600 (carbon black with a pH of 8.3, particle size of 65 nm, DBP of 82 cc/100 g, and surface area of 34 $m^2/g$, available from Columbian Chemicals) as in Example 15. Samples tested at 311° C. for 50 hours had an $R_n$ of 0.55.

EXAMPLE 20

Following the procedure of Example 19, fibers were prepared with 17% by weight Raven 14. After 50 hours at 311° C., the $R_n$ value was 0.93.

What is claimed is:

1. An electrical device which comprises (1) a PTC element comprising a conductive polymer composition which exhibits PTC behavior, which has a resistivity $R_{cp}$ at 20° C. and which comprises (a) an organic polymer which has a crystallinity of at least 5% and a melting point $T_m$, and (b) carbon black which has a pH of less than 4.0; and (2) two electrodes which can be connected to a source of electrical power to pass current through the PTC element, said electrical device having a resistance $R_i$ at 20° C. and being such that if the device is maintained at a temperature equal to $T_m$ for a period of 50 hours and is then cooled to 20° C., its resistance at 20° C., $R_{f50}$, is from $0.25R_i$ to $1.75R_i$.

2. An electrical device according to claim 1 wherein the device is such that if the device is maintained at a temperature equal to $T_m$ for a period of 300 hours and is then cooled to 20° C., its resistance at 20° C., $R_{f300}$, is from $0.5R_i$ to $1.5R_i$.

3. An electrical device according to claim 1 wherein the carbon black has a pH of less than 3.0.

4. An electrical device according to claim 1 wherein the conductive polymer comprises a polymer thick film ink.

5. An electrical device according to claim 1 wherein the electrical device comprises a heater.

6. An electrical device according to claim 1 wherein the electrical device comprises a circuit protection device.

7. An electrical device according to claim 1 wherein the polymer has a crystallinity of at least 10%.

8. An electrical device according to claim 1 wherein the conductive polymer has been crosslinked.

9. An electrical device according to claim 1 wherein the carbon black is present at at least 4% by weight.

10. An electrical device according to claim 9 wherein the carbon black is present at at least 6% by weight.

11. An electrical device according to claim 1 wherein the composition further comprises graphite.

12. An electrical device according to claim 1 wherein the composition further comprises carbon black which has a pH which is at least 5.0 and at least 1.0 pH unit greater than the carbon black having a pH of less than 4.0.

13. An electrical device according to claim 1 wherein the polymer is a fluoropolymer.

14. A conductive polymer composition which exhibits PTC behavior and which comprises (1) an organic polymer which has a crystallinity of at least 5% and a melting point $T_m$, and (2) carbon black which has a pH of less than 4.0, a particle size of D nanometers and a dry resistivity $R_{CB}$ such that $(R_{CB}/D)$ is less than or equal to 0.1.

15. A composition according to claim 14 wherein the carbon black is present at at least 4% by weight.

16. A composition according to claim 15 wherein the carbon black is present at at least 6% by weight.

17. An electrical device which comprises (1) a PTC element comprising a conductive polymer composition which exhibits PTC behavior and which comprises (a) an organic polymer which has crystallinity of at least 5% and a melting point $T_m$, and (b) carbon black which has a pH of less than 4.0, a particle size of D nanometers and a dry resistivity $R_{CB}$ such that $(R_{CB}/D)$ is less than or equal to 0.1; and (2) two electrodes which can be connected to a source of electrical power to pass current through the PTC element.

18. An electrical device according to claim 17 wherein said electrical device has a resistance $R_i$ at 20° C. and being such that if the device is maintained at a temperature equal to $T_m$ for a period of 50 hours and is then cooled to 20° C., its resistance at 20° C., $R_{f50}$, is from $0.25R_i$ to $1.75R_i$.

19. An electrical device according to claim 17 wherein the device is such that if the device is maintained at a temperature equal to $T_m$ for a period of 300 hours and is then cooled to 20° C., its resistance at 20° C., $R_{f300}$, is from $0.50R_i$ to $1.5R_i$.

* * * * *